US010939726B2

(12) United States Patent
Scofield et al.

(10) Patent No.: US 10,939,726 B2
(45) Date of Patent: Mar. 9, 2021

(54) FOOTWEAR HAVING A SOLE WITH A PLURALITY OF CHAMBERS

(71) Applicant: Chinook Asia LLC, Lake Oswego, OR (US)

(72) Inventors: Robert Kent Scofield, Lake Oswego, OR (US); Sangmin Lee, Lake Oswego, OR (US)

(73) Assignee: Chinook Asia LLC, Lake Oswego, OR (US)

( * ) Notice: Subject to any disclaimer, the term of this patent is extended or adjusted under 35 U.S.C. 154(b) by 75 days.

(21) Appl. No.: 15/986,722

(22) Filed: May 22, 2018

(65) Prior Publication Data

US 2018/0263334 A1 Sep. 20, 2018

Related U.S. Application Data

(62) Division of application No. 14/808,996, filed on Jul. 24, 2015, now Pat. No. 9,974,359.

(51) Int. Cl.

| | |
|---|---|
| ***A43B 13/12*** | (2006.01) |
| ***A43B 13/18*** | (2006.01) |
| ***A43B 13/20*** | (2006.01) |
| ***A43B 13/22*** | (2006.01) |

(52) U.S. Cl.

CPC ..... *A43B 13/181* (2013.01); *A43B 13/122* (2013.01); *A43B 13/184* (2013.01); *A43B 13/189* (2013.01); *A43B 13/20* (2013.01); *A43B 13/223* (2013.01)

(58) Field of Classification Search

CPC ..... A43B 13/12; A43B 13/122; A43B 13/125; A43B 13/181; A43B 13/189; A43B 13/20

USPC ..... 36/25 R, 28, 30 R

See application file for complete search history.

(56) References Cited

U.S. PATENT DOCUMENTS

| | | | |
|---|---|---|---|
| 302,190 | A | 7/1884 | Butterfield |
| 2,627,676 | A | 2/1953 | Hack |
| 4,071,963 | A | 2/1978 | Fukuoka |
| 4,161,828 | A | 7/1979 | Benseler et al. |
| 4,237,625 | A | 12/1980 | Cole et al. |
| 4,358,902 | A | 11/1982 | Cole et al. |
| 4,577,417 | A | 3/1986 | Cole |
| 4,722,131 | A | 2/1988 | Huang |

(Continued)

FOREIGN PATENT DOCUMENTS

WO 2014022647 A1 2/2014

OTHER PUBLICATIONS

Skechers, Skech-Air shoes with Memory Foam, purchased Mar. 2015, 8 photos.

(Continued)

*Primary Examiner* — Sharon M Prange

(74) *Attorney, Agent, or Firm* — Kolitch Romano LLP

(57) ABSTRACT

Soles for footwear and footwear are disclosed. The sole may include a midsole having a first surface. The sole may additionally include an outsole having a second surface and a plurality of first recesses. The second surface may be attached to the first surface. The first surface and the plurality of first recesses may define a plurality of chambers. One or more chambers of the plurality of chambers may include trapped air. The midsole may further include first protruding portions that extend downwardly from the first surface toward one or more first recesses of the plurality of first recesses.

5 Claims, 14 Drawing Sheets

(56) References Cited

U.S. PATENT DOCUMENTS

| | | | | |
|---|---|---|---|---|
| 5,794,359 | A | 8/1998 | Jenkins et al. | |
| D397,849 | S | 9/1998 | Mitsui et al. | |
| 5,901,467 | A | 5/1999 | Peterson et al. | |
| 5,925,306 | A | 7/1999 | Huang | |
| 5,926,974 | A | 7/1999 | Friton | |
| 6,009,637 | A | 1/2000 | Pavone | |
| D520,220 | S | 5/2006 | Morgan et al. | |
| 7,152,343 | B2 | 12/2006 | Whatley | |
| D540,014 | S | 4/2007 | Turner et al. | |
| D554,840 | S | 11/2007 | McClaskie | |
| 7,313,875 | B2 | 1/2008 | Morgan | |
| 7,779,558 | B2 | 8/2010 | Nishiwaki et al. | |
| 7,784,196 | B1 | 8/2010 | Christensen et al. | |
| 7,797,856 | B2 | 9/2010 | Andrews et al. | |
| D658,356 | S | 5/2012 | Bacon et al. | |
| D680,726 | S | 4/2013 | Propet | |
| 8,752,307 | B2 | 6/2014 | Cooper et al. | |
| D708,430 | S | 7/2014 | Weeks | |
| D711,636 | S | 8/2014 | Christensen et al. | |
| D725,881 | S | 4/2015 | Weeks | |
| D734,008 | S | 7/2015 | Marvin et al. | |
| D734,930 | S | 7/2015 | Bikowski | |
| D736,508 | S | 8/2015 | Taestensen | |
| 9,144,267 | B2 | 9/2015 | Lo | |
| D742,106 | S | 11/2015 | Taestensen | |
| D746,561 | S | 1/2016 | Bikowski | |
| 9,320,317 | B2 * | 4/2016 | Bernhard | A43B 13/181 |
| D756,093 | S | 5/2016 | Mahoney | |
| 2004/0148803 | A1 | 8/2004 | Grove et al. | |
| 2006/0130368 | A1 | 6/2006 | Morgan | |
| 2007/0028484 | A1 | 2/2007 | Akhidime | |
| 2008/0184600 | A1 | 8/2008 | Yang | |
| 2008/0244926 | A1 | 10/2008 | Yu et al. | |
| 2010/0031533 | A1 | 2/2010 | Keenan et al. | |
| 2010/0050471 | A1 | 3/2010 | Kim | |
| 2010/0180474 | A1 | 7/2010 | Clark et al. | |
| 2010/0212185 | A1 | 8/2010 | Cooper et al. | |
| 2012/0222332 | A1 | 9/2012 | Greene et al. | |
| 2012/0227289 | A1 | 9/2012 | Beers et al. | |
| 2014/0196308 | A1 | 7/2014 | Baratta et al. | |
| 2014/0202031 | A1 | 7/2014 | Seo | |
| 2014/0230272 | A1 | 8/2014 | Feshbach et al. | |
| 2014/0259748 | A1 | 9/2014 | Bernhard et al. | |
| 2014/0283413 | A1 | 9/2014 | Christensen et al. | |
| 2015/0040425 | A1 | 2/2015 | Adams | |

OTHER PUBLICATIONS

Oct. 24, 2016, Notice of Allowance from the U.S. Patent and Trademark Office, in Design U.S. Appl. No. 29/534,076, which is the design counterpart application to this U.S. application.

Oct. 26, 2016, International Search Report of the International Searching Authority from the U.S. Receiving Office, in PCT Application No. PCT/US2016/043426, which is the international application to this U.S. application.

Oct. 26, 2016, Written Opinion of the International Searching Authority from the U.S. Receiving Office, in PCT Application No. PCT/US2016/043426, which is the international application to this U.S. application.

Mar. 1, 2017, Office Action from the U.S. Patent and Trademark Office, in U.S. Appl. No. 14/808,996, which is the parent to this U.S. application.

Sep. 8, 2017, Final Office Action from the U.S. Patent and Trademark Office, in U.S. Appl. No. 14/808,996, which is the parent to this U.S. application.

* cited by examiner

FOOTWEAR HAVING A SOLE WITH A PLURALITY OF CHAMBERS

CROSS-REFERENCE TO RELATED APPLICATIONS

This application is a divisional application of U.S. patent application Ser. No. 14/808,996, which was filed on Jul. 24, 2015 and entitled "Footwear Having A Sole With A Plurality Of Chambers." The complete disclosure of the above application is hereby incorporated by reference for all purposes.

INTRODUCTION

Work boots, athletic footwear, and other types of footwear may have components that are designed to provide for cushioning, shock absorption, and traction. Footwear typically includes a sole having at least a midsole and an outsole. The midsole is generally constructed of materials to provide for cushioning and shock absorption, while the outsole is generally constructed of materials to provide for traction with a support surface.

SUMMARY

Disclosed herein are examples of footwear and soles for footwear.

In one example, soles for footwear are disclosed. The sole may include a midsole having a first surface. The sole may additionally include an outsole having a second surface and a plurality of first recesses. The second surface may be attached to the first surface. The first surface and the plurality of first recesses may define a plurality of chambers. One or more chambers of the plurality of chambers may include trapped air. The midsole may further include first protruding portions that extend downwardly from the first surface toward one or more first recesses of the plurality of first recesses.

In another example, footwear are disclosed. The footwear may include an upper for receiving a foot of a user. The footwear may additionally include a sole having a midsole and an outsole. The midsole may include a first surface. The outsole may include a second surface and a plurality of first recesses. The second surface may be attached to the first surface. The first surface and the plurality of first recesses may define a plurality of chambers. One or more chambers of the plurality of chambers may include trapped air. The midsole may further include first protruding portions that extend downwardly from the first surface toward one or more first recesses of the plurality of first recesses.

Features, functions, and advantages may be achieved independently in various embodiments of the present disclosure, or may be combined in yet other embodiments, further details of which can be seen with reference to the following description and drawings.

DETAILED DESCRIPTION OF THE DISCLOSURE

Overview

Figure 1:
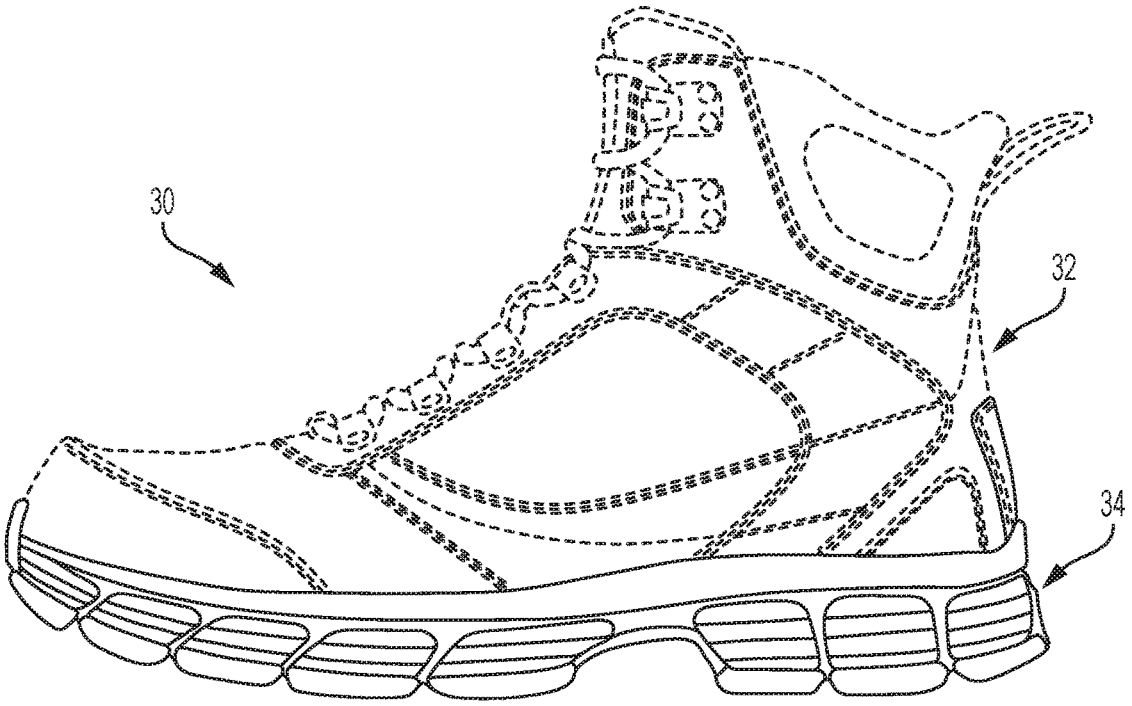
FIG. 1 is a side view of an example of footwear of the present disclosure having a plurality of chambers.
Figure 2:
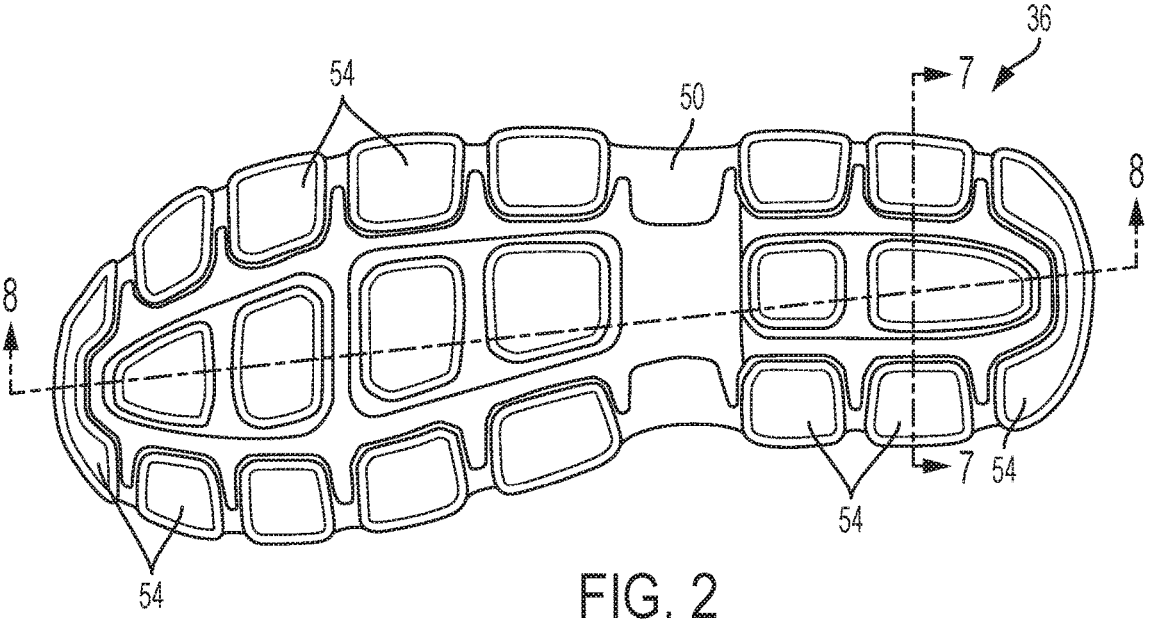
FIG. 2 is a bottom view of the footwear of FIG. 1.

Various embodiments of footwear having a sole with a plurality of chambers are described below and illustrated in the associated drawings. Unless otherwise specified, an embodiment and/or its various components may contain at least one of the structure, components, functionality, and/or variations described and/or illustrated herein. Furthermore, the structures, components, functionalities, and/or variations described and/or illustrated herein in connection with the present teachings may be included in other embodiments. The following description of various embodiments is merely illustrative in nature and is in no way intended to limit the disclosure, its application, or uses. Additionally, the advantages provided by the embodiments, as described below, are illustrative in nature and not all embodiments provide the same advantages or the same degree of advantages.

Disclosed herein are footwear having a sole with a plurality of chambers. In some embodiments, the midsole and the outsole may form a plurality of chambers. In some embodiments, one or more of the chambers may include trapped air. Alternatively, or additionally, one or more of the chambers may include gel, foam, insert(s), drop-in(s), and/or other materials.

Examples, Components, and Alternatives

The following examples describe selected aspects of illustrative embodiments as well as related systems and/or methods. These examples are intended for illustration and should not be interpreted as limiting the entire scope of the present disclosure. Each example may include one or more distinct inventions, and/or contextual or related information, function, and/or structure.

Example 1

FIGS. 1-8 show an example of footwear 30 of the present disclosure. The footwear may include an upper 32 and a sole 34 attached to the upper. Upper 32 may cover any suitable portion of a user's foot. For example, the upper in FIG. 1 has a high cut (or high top) that is designed to extend above a user's ankle bone. Although upper 32 is shown as having a high cut, upper 32 may have a low cut (or low top) that does not extend above a user's ankle bone or may have any suitable cut that covers any suitable portion of a user's foot.

Sole 34 may include any suitable layers, such as an outsole (or outer sole layer) 36 and a midsole (or midsole layer) 38. Outsole 36 and/or midsole 38 may include any suitable material(s), such as rubber, ethylene-vinyl acetate (EVA), thermoplastic polyurethane (TPU), and/or other materials.

Outsole 36 may extend at least substantially the entire length of the footwear. Although the footwear of FIGS. 1-18 includes an outsole that wraps around at least a portion of the toe of the footwear, the footwear of the present disclosure may include any suitable outsole. In some examples, the footwear may include an outsole 36 that does not wrap around the toe and/or may wrap around at least a portion of the heel of the footwear.

Outsole 36 may include a forefoot portion 42, a midfoot portion 44, and a heel portion 46. Additionally, the outsole may have an upper surface 48 and a lower surface 50. The upper surface may include a base surface or base 51 and a plurality of depressions or recesses 52. Lower surface 50 may include one or more projections 54, which may be formed from recesses 52 of the upper surface. One or more of the projections may be configured to contact a support surface. Lower surface 50 may include one or more projections 54 that are not formed by recesses 52 on upper surface 48, such as the U-shaped projections on the forefoot and heel portions of lower surface 50 that are not formed by recesses 52 on upper surface 48.

Recesses 52 may be distributed along upper surface 48 in any suitable configuration and/or layout. For example, upper surface 48 may include transverse end portions 56, 58 and a central portion 60 disposed between the transverse end portions. One or more of transverse end portions 56, 58 and/or central portion 60 may include one or more recesses 52. In some embodiments, each of the transverse end portions and/or central portion may include one or more recesses 52. Although upper surface 48 is shown to include recesses 52 in each of the transverse end portions and central portion, the upper surface may include recesses 52 in only one or both of the transverse end portions, in only the central portion, and/or any suitable combination. In some embodiments, upper surface 48 may include recesses 52 in only forefoot portion 42, in only midfoot portion 44, in only heel portion 46, in only the forefoot and heel portions, in only the forefoot and midfoot portions, or in only the midfoot and heel portions. Other combinations of the above configurations are included in the present disclosure, such as recesses 52 in only both transverse end portions and in only the forefoot and/or heel portions, etc.

Each portion of upper surface 48 may include any suitable number of recesses 52. For example, one or both transverse end portions 56, 58 and/or central portion 60 may each include one, two, three, four, five, six, seven, eight, nine or more recesses 52. Additionally, or alternatively, the forefoot, midfoot, and/or heel portion(s) may each include one, two, three, four, five, six, seven, eight, nine or more recesses 52.

Recesses 52 may include any suitable structure. For example, one or more recesses 52 may include a bottom surface 62 and a plurality of sidewalls 64. The recesses may have any suitable shape(s). For example, one or more recesses 52 may be triangular-shaped and have only three sidewalls 64. Additionally, or alternatively, one or more recesses 52 may be square-shaped or rectangular-shaped and have only four sidewalls 64. Recesses 52 may be shaped in other suitable ways, such as circular-shaped, U-shaped, V-shaped, etc. Sidewalls 64 may include any suitable shape(s). For example, one or more sidewalls 64 may be concave-shaped, such as to correspond to one or more projections from the midsole that include convex-shaped wall(s) as discussed further below.

In some embodiments, recesses 52 may include one or more inclined surfaces 66 disposed between base 51 and sidewalls 64. Inclined surfaces 66 may, for example, provide a perimeter 68 around the sidewalls and/or the bottom surface. The inclined surfaces may have any suitable shape(s). For example, one or more inclined surfaces 66 may be concave-shaped, such as to correspond to one or more protruding portions of the midsole that are convex-shaped, as further discussed below.

Figure 5:
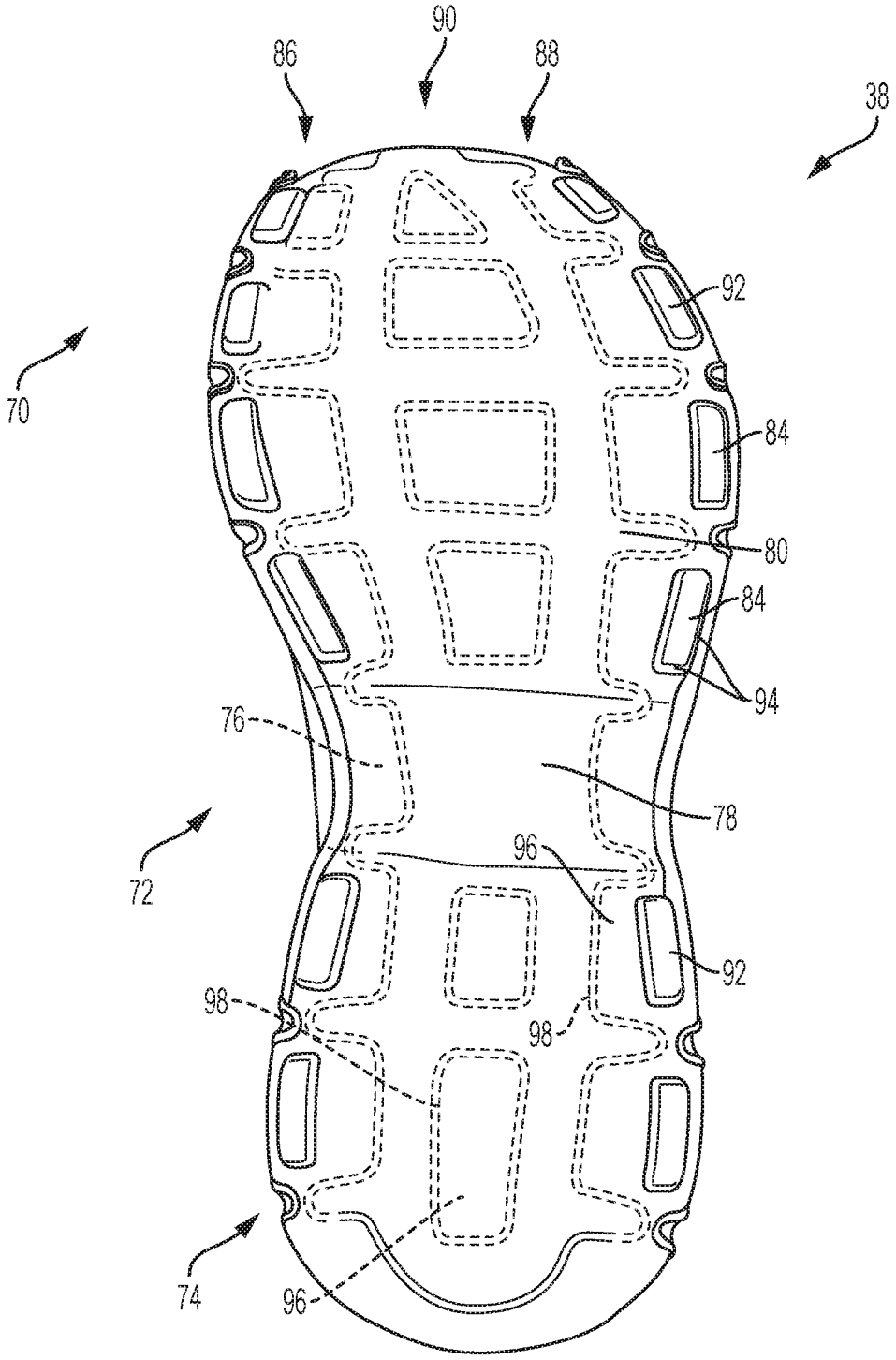
FIG. 5 is a bottom view of the midsole of FIG. 3.
Figure 6:
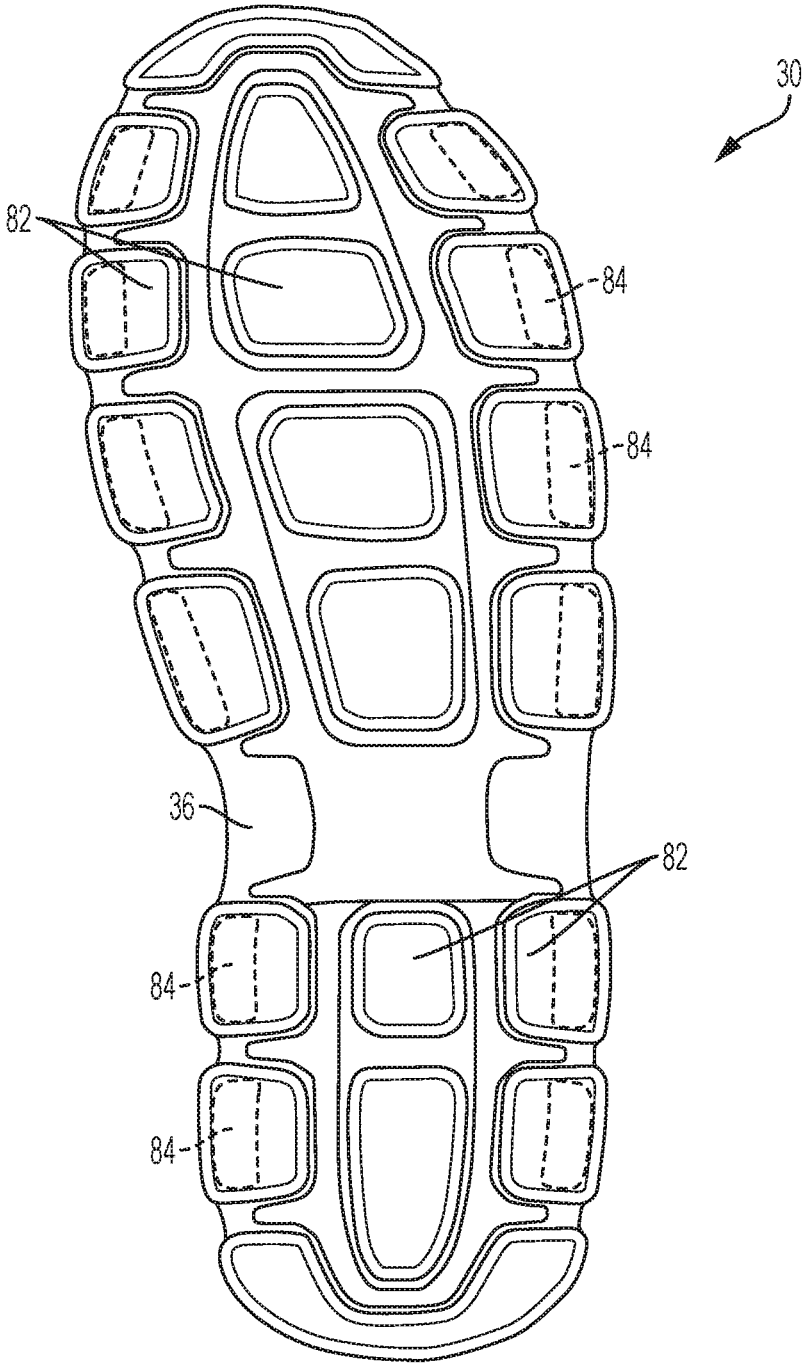
FIG. 6 is a bottom view of the footwear of FIG. 1, showing projections of the midsole received in recesses of the outsole.

As shown in FIG. 5, midsole 38 may include a forefoot portion 70, a midfoot portion 72, and a heel portion 74. Additionally, the midsole may have an upper surface 76 and a lower surface 78. Lower surface 78 may include a base surface or base 80 that is attached to base 51 of outsole 36. When attached, base 80 and recesses 52 may define a plurality of compartments or chambers 82 having trapped air and/or other materials, such as shown in FIG. 6. During the manufacturing process, attaching the midsole and the outsole may trap ambient air in the chamber(s). When chambers 82 include trapped air, those chambers may sometimes be referred to as "air chambers," "ambient air chambers," "air pods," or "air pockets." Alternatively, or additionally, one or more chambers 82 may include gel, foam, and/or other materials, such as insert(s) or drop-in(s) sized to be received in the recess(es) and/or chamber(s). The insert(s) or drop-in(s) may be made of any suitable material(s) and/or may provide for one or more functions. For example, the insert may be made of polyurethane and/or provide for increased shock absorption. Sole 34 may include any suitable combination of air chambers, chambers with gel, chambers with foam, chambers with inserts, and/or chambers with other materials depending on the shock absorption, traction, cushioning, and/or other characteristics desired.

Lower surface 78 of midsole 38 may include a plurality of first protruding portions 84 that are configured to extend downwardly from base 80 toward one or more recesses 52 of the outsole. In some embodiments, one or more first protruding portions 84 may contact bottom surface 62 of one or more recesses 52. The first protruding portions may be contained within one or more chambers 82. First protruding portions 84 may have any suitable size(s) configured to be received in recesses 52 and/or chambers 82. For example, first protruding portions 84 may occupy any suitable portion(s) of chambers 82, such as about 30% to about 50%, as shown in FIG. 6.

The first protruding portions may be distributed along lower surface 78 in any suitable configuration and/or layout to correspond one or more recesses 52. For example, lower surface 78 may include transverse end portions 86, 88 and a central portion 90. In some embodiments, lower surface 78 may include first protruding portions 84 in only transverse end portions 86, 88. Alternatively, that surface may include the first protruding portions in only one of the transverse end portions, in only the central portion, and/or any suitable combination. In some embodiments, lower surface 78 may include first protruding portions in only forefoot portion 70, in only midfoot portion 72, in only heel portion 74, in only the forefoot and heel portions, in only the forefoot and midfoot portions, or in only the midfoot and heel portions. Other combinations of the above configurations are included in the present disclosure, such as first protruding portions 84 in only one transverse end portion and in only the forefoot and/or heel portions, etc.

Each portion of lower surface 78 may include any suitable number of first protruding portions 84. For example, one or both transverse end portions 86, 88 and/or central portion 90 may each include one, two, three, four, five, six, seven, eight, nine or more first protruding portions 84. Additionally, or alternatively, the forefoot, midfoot, and/or heel portion(s) may each include one, two, three, four, five, six, seven, eight, nine or more first protruding portions 84.

Figure 7:
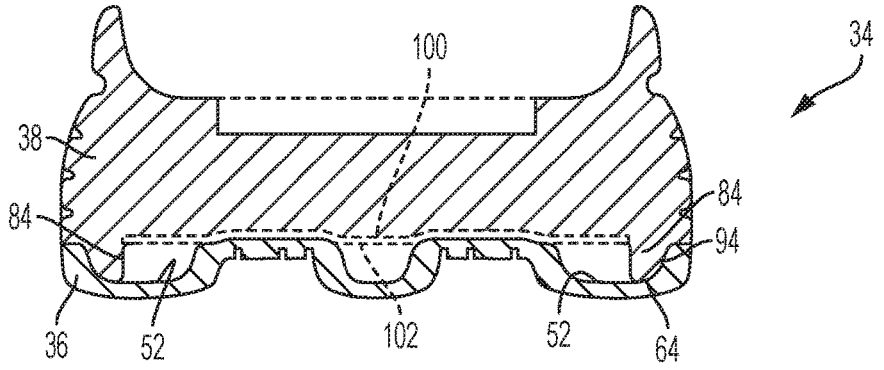
FIG. 7 is a partial sectional view of the sole of the footwear of FIG. 1 taken along lines 7-7 in FIG. 2.

First protruding portions 84 may include any suitable structure. For example, one or more first protruding portions 84 may include a top surface 92 and a plurality of sidewalls 94. The first protruding portions may have any suitable shape(s). For example, one or more first protruding portions 84 may be square-shaped or rectangular-shaped and have only four sidewalls 94. Recesses 52 may be shaped in other suitable ways, such as triangular-shaped, circular-shaped, U-shaped, V-shaped, etc. Sidewalls 94 may include any suitable shape(s). For example, one or more sidewalls 94 may be shaped to correspond to the shape of one or more adjacent sidewalls 64 of recesses 52 such that one or more sidewalls 94 are in contact with at least a portion of one or more sidewalls 64, as shown in FIG. 7. In some embodiments, one or more sidewalls 94 of first protruding portions 84 may be convex-shaped to correspond to one or more concave-shaped sidewalls 64 of recesses 52. In some embodiments, entire sidewall(s) 94 may be in contact with entire sidewall(s) 64.

In some embodiments, lower surface 78 of midsole 38 may include one or more second protruding portions 96 configured to be received in recesses 52 of outsole 36. In some embodiments, second protruding portions 96 may extend downwardly from base 80 substantially less than first protruding portions 84. Second protruding portions 96 may include a perimeter 98 and may be any suitable shape(s) to correspond to the shape(s) of the recesses. When recesses 52 include inclined surfaces 66, perimeter 98 of second protruding portions 96 may be configured to be received on and contact inclined surfaces 66. For example, when inclined surfaces 66 are concave-shaped, second protruding portions 96 may include a convex-shaped perimeter 98.

Lower surface 78 may include any suitable second protruding portions 96 for all recesses 52 or for less than all of the recesses. For example, lower surface 78 may include second protruding portions 96 in only one or both of the transverse end portions, in only the central portion, and/or any suitable combination. In some embodiments, lower surface 78 may include second protruding portions 96 in only forefoot portion 70, in only midfoot portion 72, in only heel portion 74, in only the forefoot and heel portions, in only the forefoot and midfoot portions, or in only the midfoot and heel portions. Other combinations of the above configurations are included in the present disclosure, such as second protruding portions 96 in only one transverse end portion and in only the forefoot and/or heel portions, etc.

Figure 3:
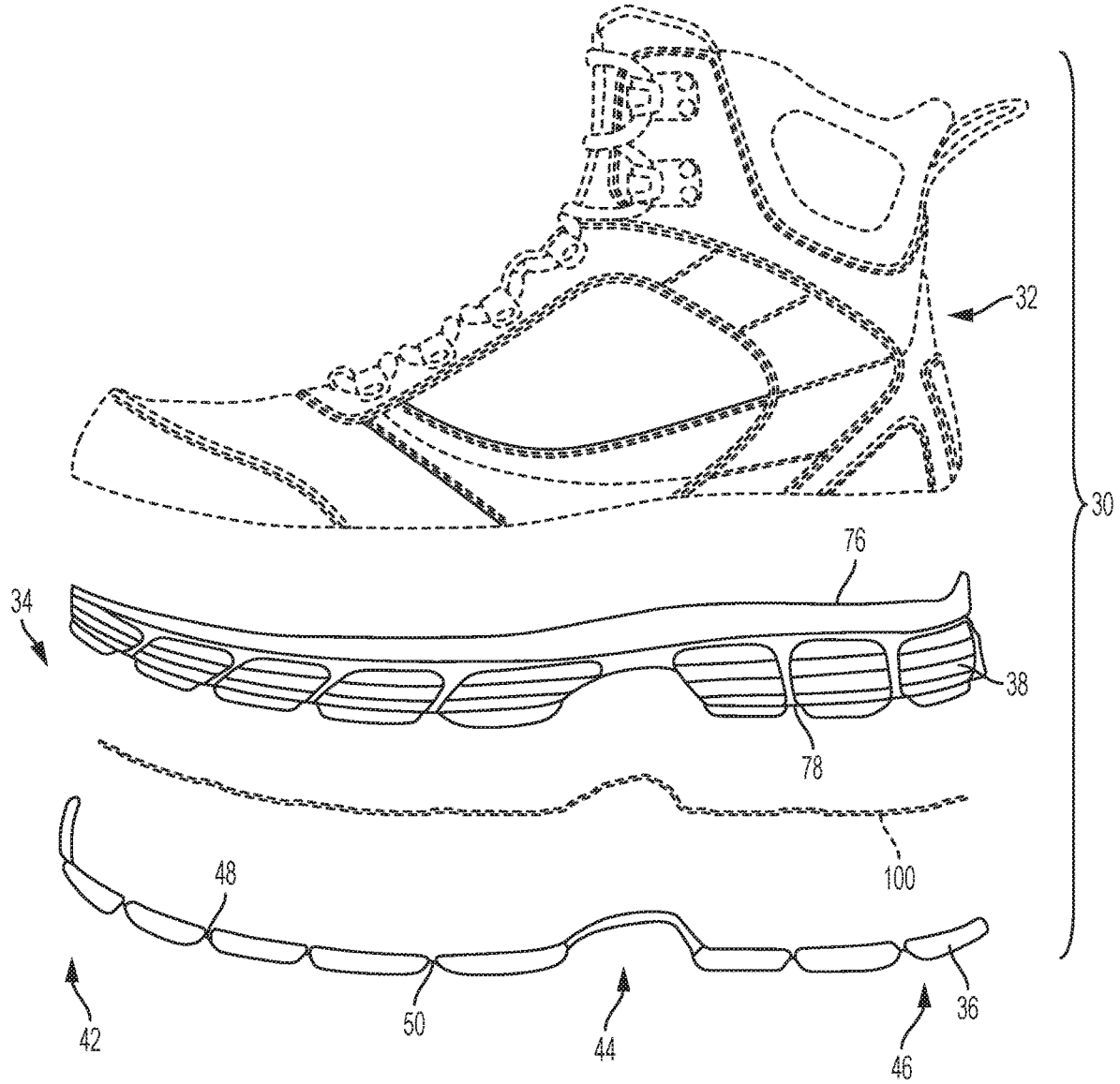
FIG. 3 is an exploded view of the footwear of FIG. 1, showing a shoe upper, a midsole, and an outsole.
Figure 4:
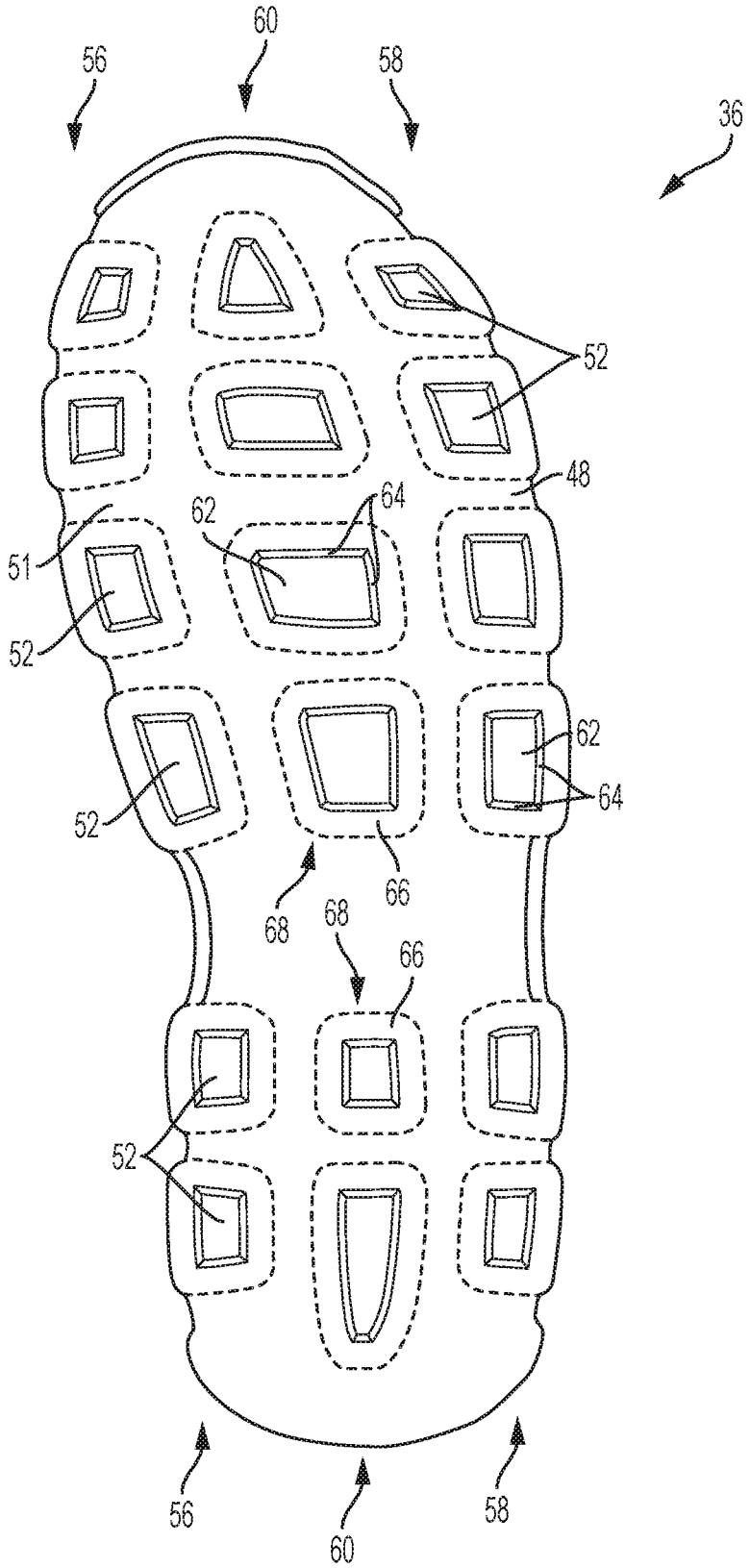
FIG. 4 is a top view of the outsole of FIG. 3.
Figure 8:
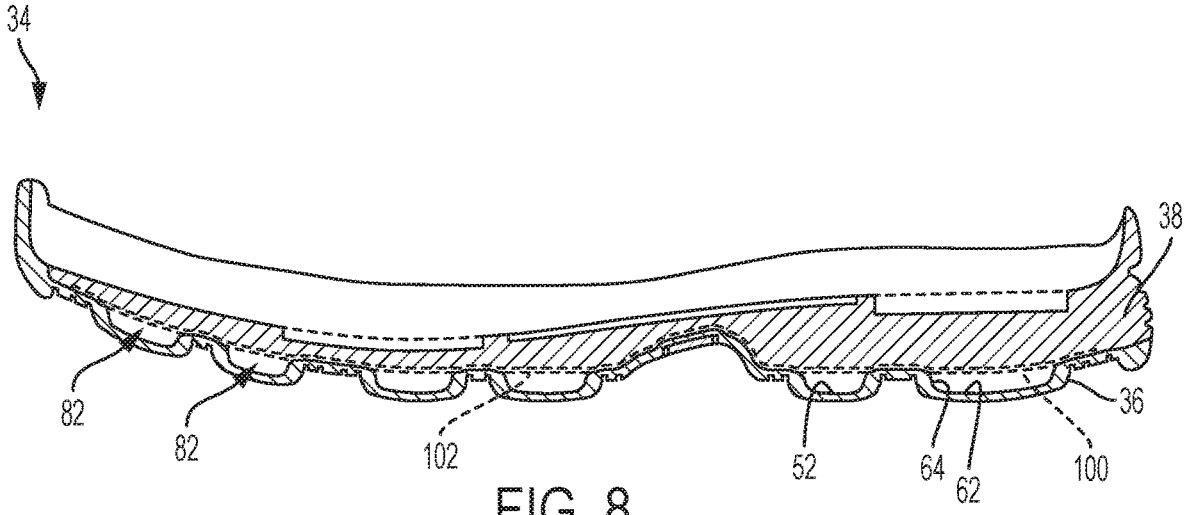
FIG. 8 is a partial sectional view of the sole of the footwear of FIG. 1 taken along lines 8-8 in FIG. 2.

In some embodiments, sole 34 may include an interface or gasket layer 100, as shown in FIGS. 3 and 7-8. The gasket layer may be disposed between the midsole and the outsole, such as between upper surface 48 and lower surface 78. Additionally, gasket layer 100 may be configured to seal the trapped air in chambers 82. The gasket layer may be made of any suitable material(s). In some embodiments, midsole 38 (such as lower surface 78) may include a channel 102 sized to receive the gasket layer.

Examples 2-4

Figure 9:
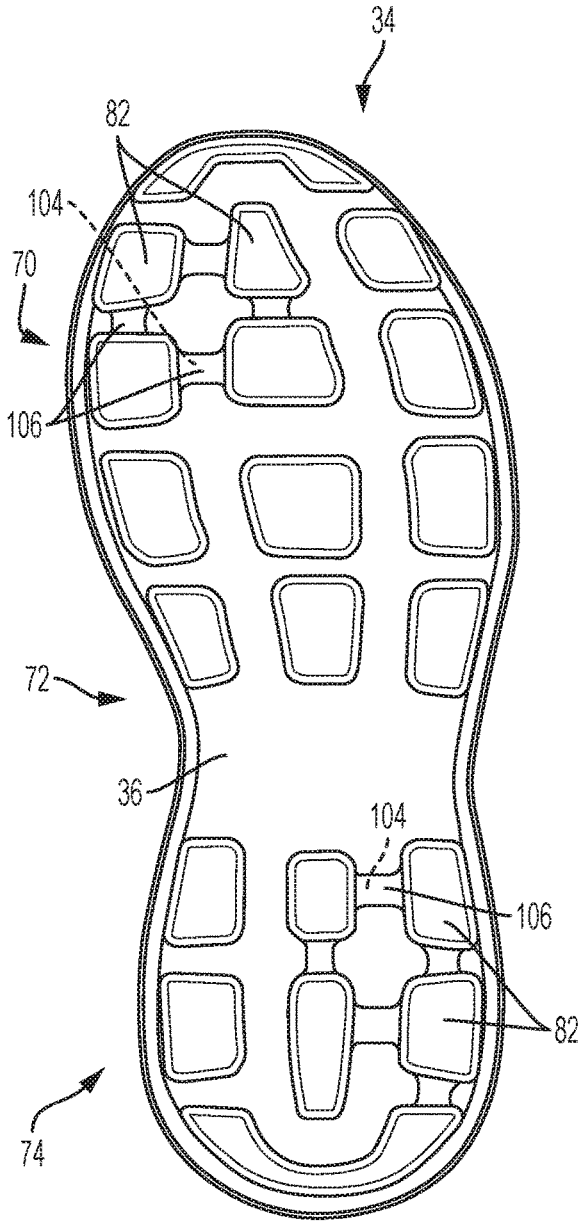
FIGS. 9-11 are bottom views of other examples of the sole of the footwear of FIG. 1.
Figure 10:
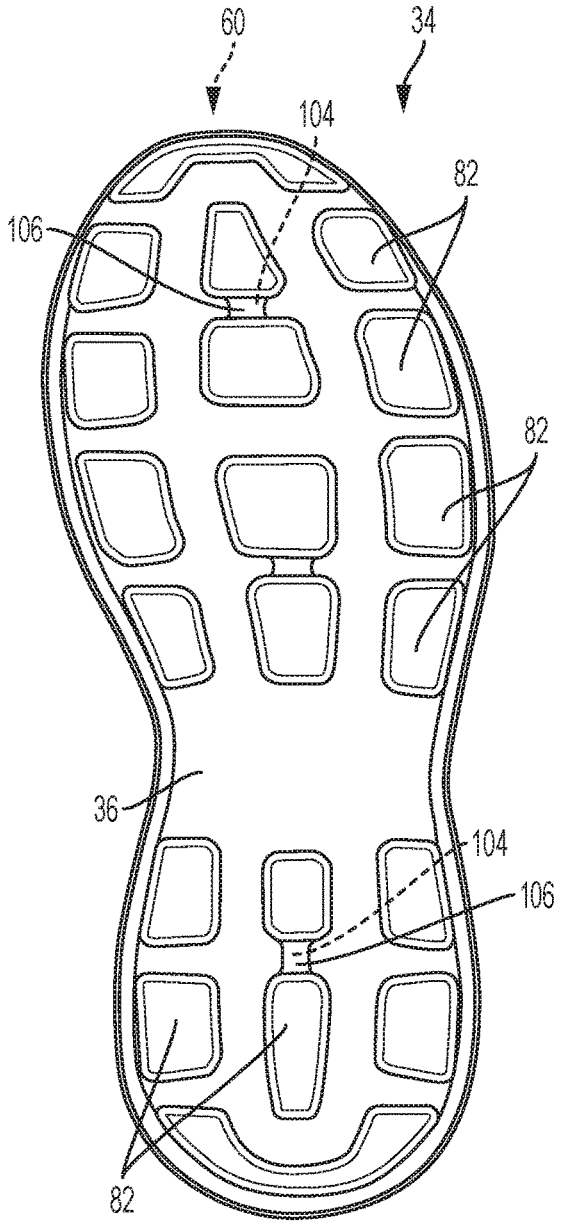
Figure 11:
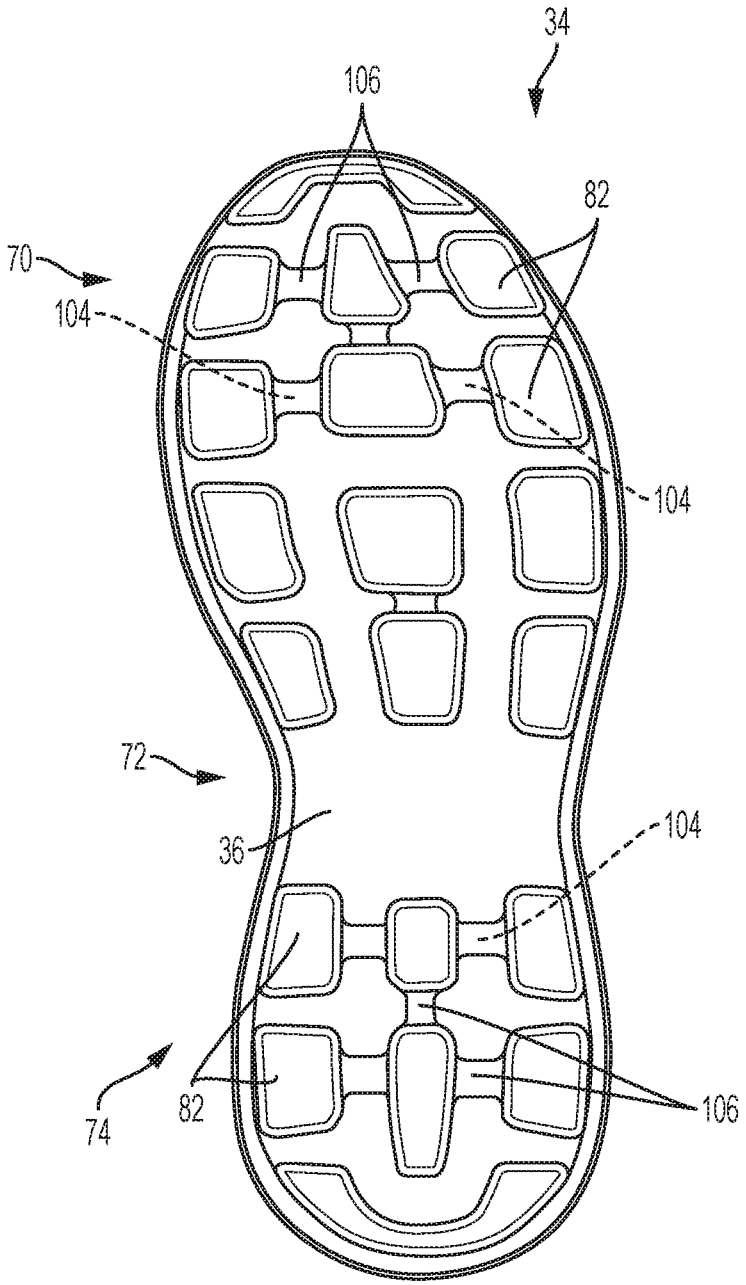
Figure 12:
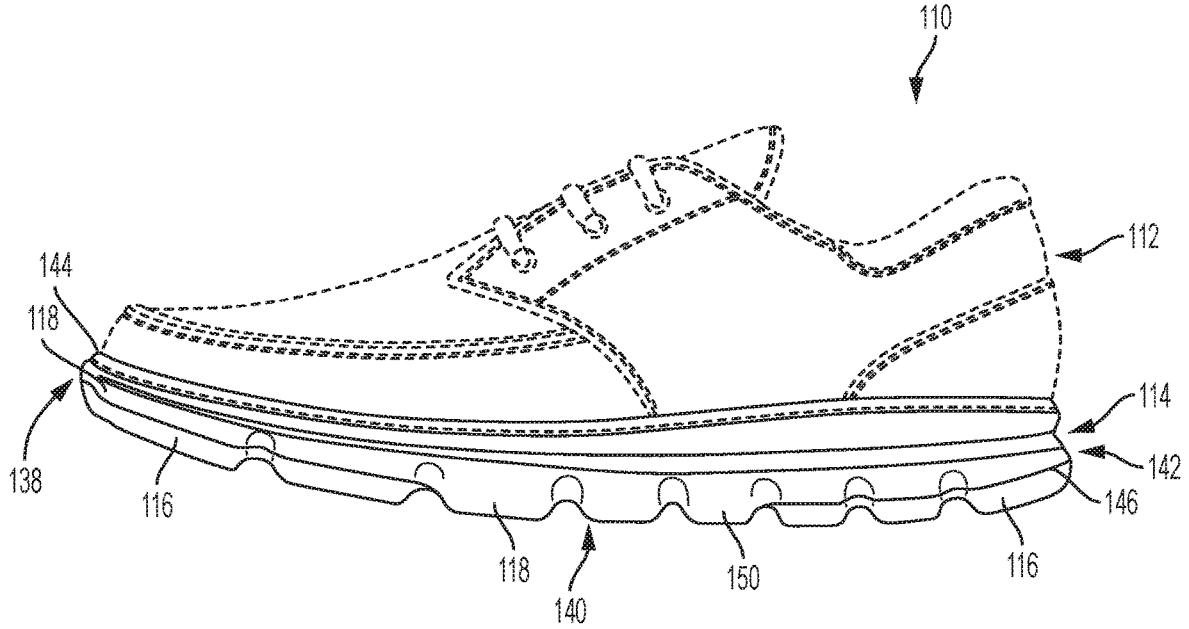
FIG. 12 is a side view of another example of footwear of the present disclosure.

FIGS. 9-11 show embodiments of sole 34, similar to those described above, but with two or more chambers 82 being in fluid communication with each other. For example, an upper surface of outsole 36 may include one or more connector recesses 104 such that, when the midsole and outsole are attached, a lower surface of the midsole and connector recesses 104 define one or more passages 106 that fluidly connect two or more chambers. In other words, the passages allow two or more chambers to share the trapped air and/or other fluids in the chambers.

FIG. 9 shows four chambers 82 in forefoot portion 70 fluidly connected to each other and five chambers 82 in heel portion 74 fluidly connected to each other. FIG. 10 shows three pairs of fluidly connected chambers 82 in central portion 60. FIG. 11 shows six chambers 82 in forefoot portion 70, two chambers 82 in midfoot portion 72 fluidly connected to each other, and six chambers 82 in heel portion 74 fluidly connected to each other. Other variations of fluidly connected chambers are included in the present disclosure.

Examples 5-7

FIGS. 12-19 show different embodiments of footwear 30, which is generally indicated at 110. Footwear 110 may include a shoe upper 112 and a sole 114 attached to the upper. Upper 112 may cover any suitable portion of a user's foot. For example, the uppers in FIG. 12-17 are low cut (or low top) uppers that do not extend above a user's ankle bone.

Sole 114 may include any suitable layers, such as an outsole (or outer sole layer) 116 and a midsole (or midsole layer) 118. Outsole 116 and/or midsole 118 may include any suitable material(s), such as rubber, ethylene-vinyl acetate (EVA), thermoplastic polyurethane (TPU), and/or other materials.

Figure 13:
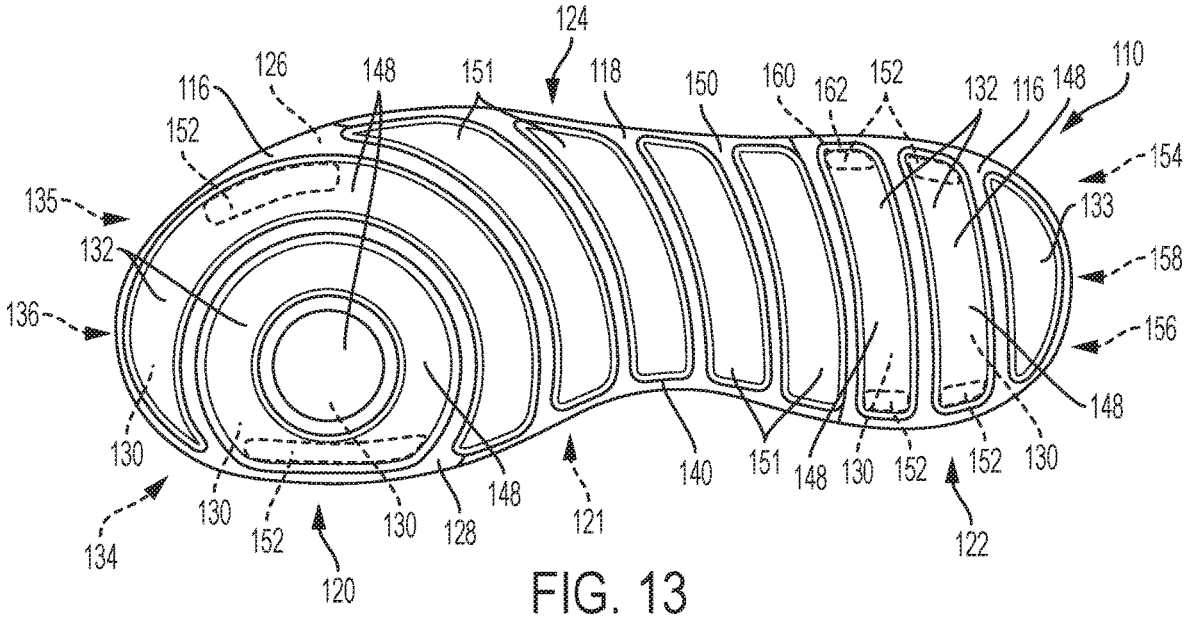
FIG. 13 is a bottom view of the footwear of FIG. 12, showing projections of the midsole received in recesses of the outsole.
Figure 14:
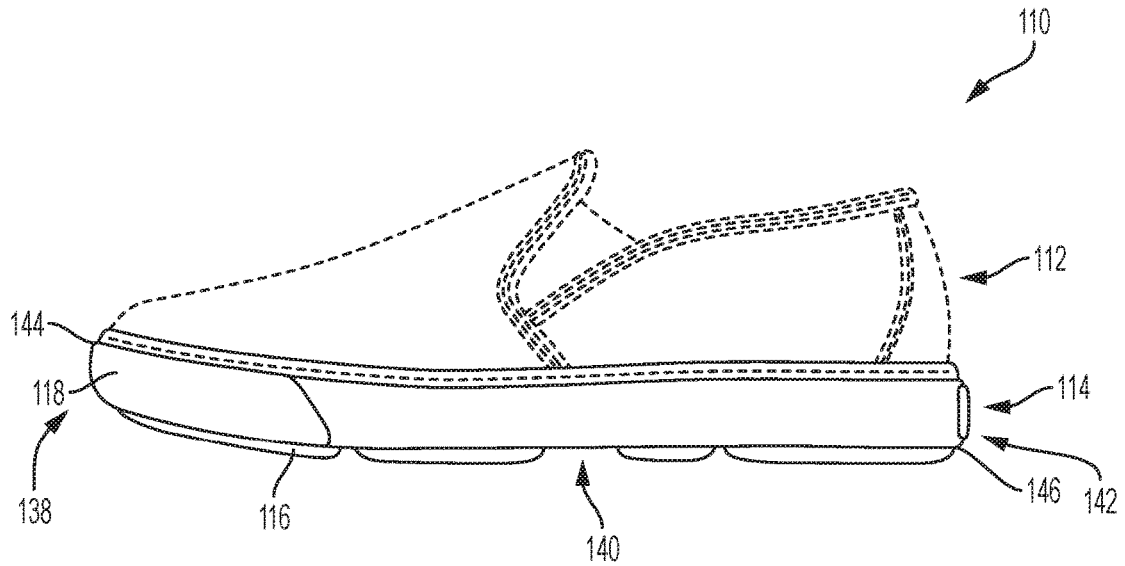
FIG. 14 is a side view of a further example of footwear of the present disclosure.

Outsole 116 may include a forefoot portion 120, a midfoot portion 121, and a heel portion 122. In some embodiments, outsole 116 may exclude one or more portions, such as midfoot portion 121. For example, forefoot portion 120 and heel portion 122 may define an aperture or cavity 124 therebetween (such as where at least a portion of midfoot portion 121 would have been), as shown in FIG. 13. When outsole 116 excludes or does not include one or more portions, the outsole may be sometimes referred as "segmented outsole" 116. Alternatively, or additionally, outsole 116 may include one or more cavities in the forefoot, midfoot, and/or heel portions. For example, outsole 116 in FIG. 17 includes cavities 124 in forefoot portion 120.

The outsole may have an upper surface 126 and a lower surface 128. The upper surface may include a plurality of depressions or recesses 130. Lower surface 128 may include one or more projections 132, which may be formed from recesses 130 of the upper surface. Lower surface 128 may include one or more projections 132 that are not formed by recesses 130 on upper surface 126 and/or extend outward from lower surface 128, such as indicated at 133 in FIGS. 13 and 17. Those projections may sometimes be referred to as "non-chamber projections." Non-chamber projections 133 may be made of any suitable material(s), such as solid rubber.

Recesses 130 may be distributed along upper surface 126 in any suitable configuration and/or layout. For example, upper surface 126 may include transverse end portions 134, 135 and a central portion 136 disposed between the transverse end portions or extend from one transverse end portion to the other transverse end portion. One or more recesses 130 may extend between transverse end portions 134, 135. Alternatively, or additionally, one or more recesses 130 may extend from one of the transverse end portions to the other of the transverse end portions, and back to the initial transverse end portion, such as shown in FIG. 13. In some embodiments, upper surface 126 may include recesses 130 in only forefoot portion 120, in only midfoot portion 121, in only heel portion 122, in only the forefoot and heel portions, in only the forefoot and midfoot portions, or in only the midfoot and heel portions. Other combinations of the above configurations are included in the present disclosure.

Figure 15:
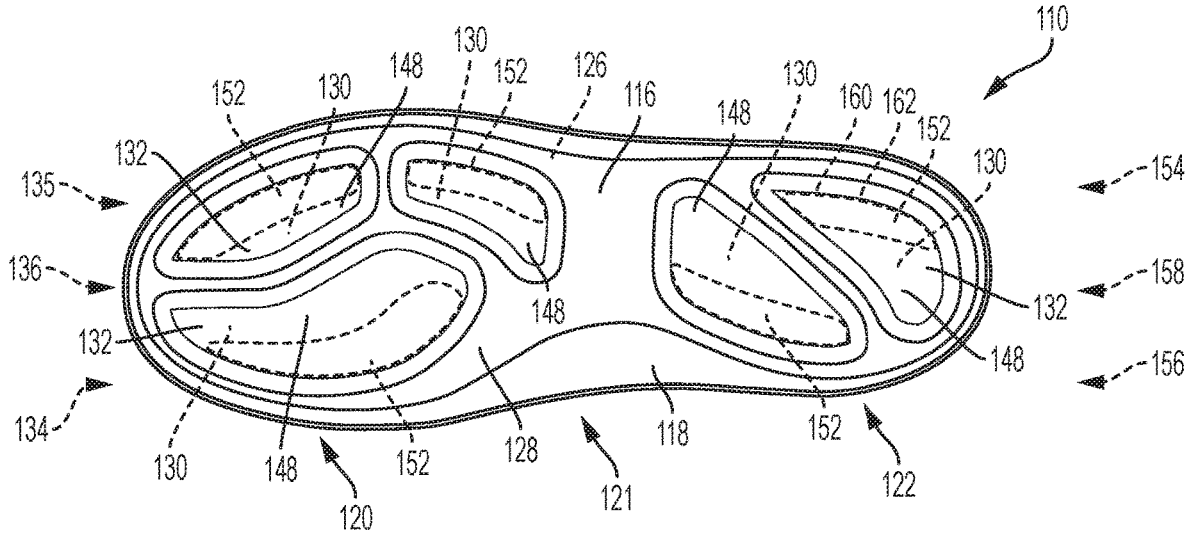
FIG. 15 is a bottom view of the footwear of FIG. 14, showing projections of the midsole received in recesses of the outsole.
Figure 16:
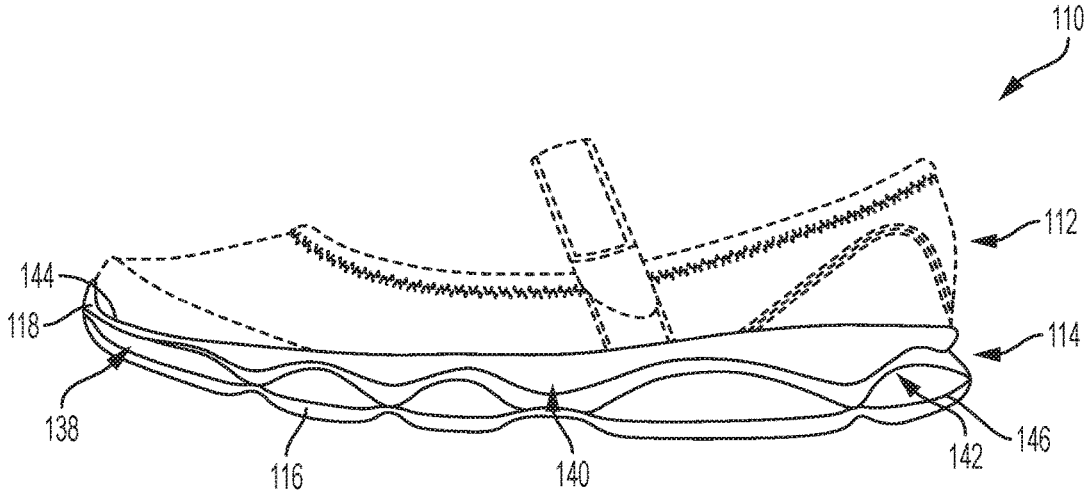
FIG. 16 is a side view of another example of footwear of the present disclosure.
Figure 17:
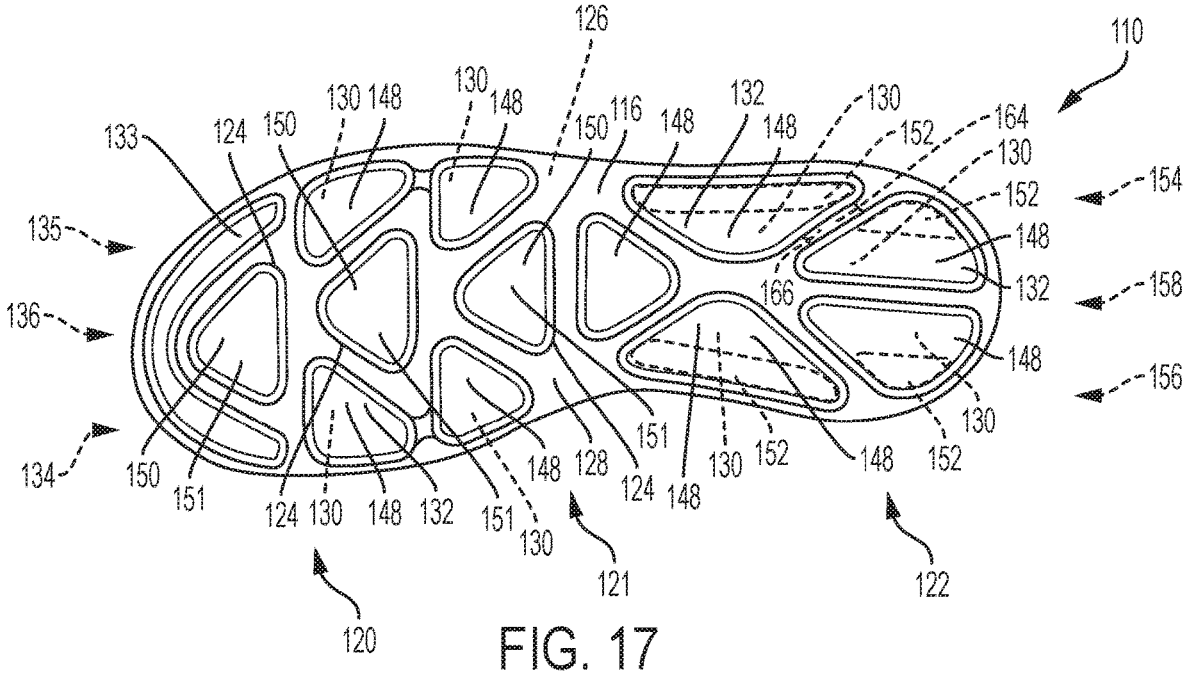
FIG. 17 is a bottom view of the footwear of FIG. 16, showing projections of the midsole received in recesses of the outsole.
Figure 18:
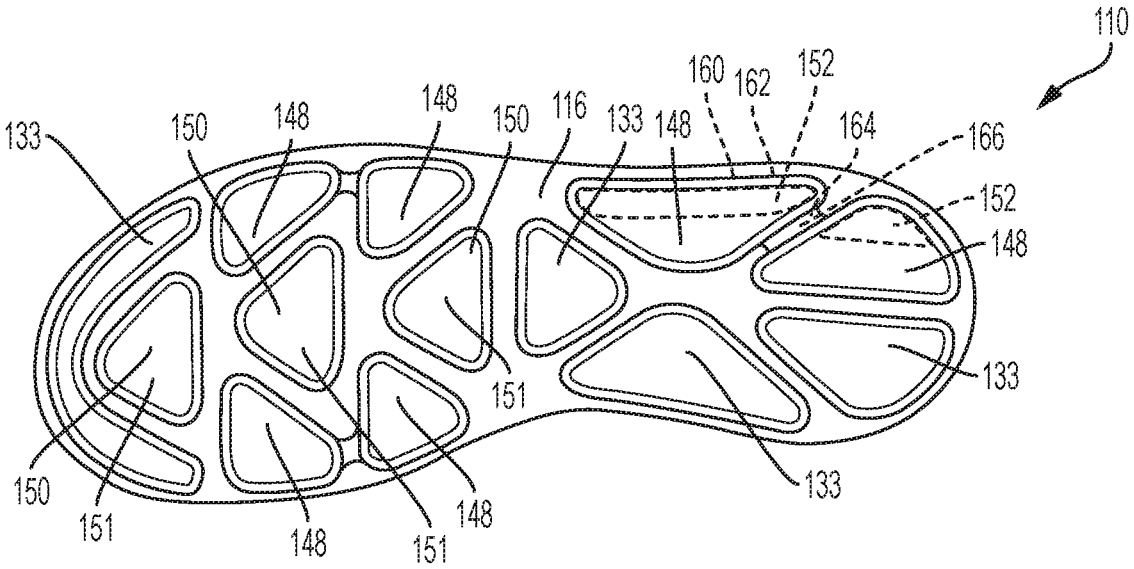
FIG. 18 is a bottom view of another example of the footwear of FIG. 16.

Each portion of upper surface 126 may include any suitable number of recesses 130. For example, the forefoot, midfoot, and/or heel portion(s) may each include one, two, three, four, five, six or more recesses 130. Recesses 130 (and the corresponding projections 132) may be shaped in any suitable way(s), such as elongate, circular-shaped, kidney-shaped, ring-shaped, triangular-shaped, U-shaped, V-shaped, other shape(s), and any suitable combination of shapes. For example, FIG. 13 shows recesses 130 that are elongate and/or ring-shaped or circular-shaped. Additionally, FIG. 15 shows recesses 130 that are kidney-shaped, while FIG. 17 shows recesses 130 that are triangular-shaped. Non-chamber projections 133 may be shaped in any suitable way(s), such as elongate, circular-shaped, kidney-shaped, ring-shaped, triangular-shaped, U-shaped, V-shaped, other shape(s), and any suitable combination of shapes. For example, FIG. 13 shows a non-chamber projection 133 that is elongate and/or half-moon shaped. Additionally, FIGS. 17-18 show non-chamber projections 133 that are U-shaped and triangular-shaped, respectively.

Figure 19:
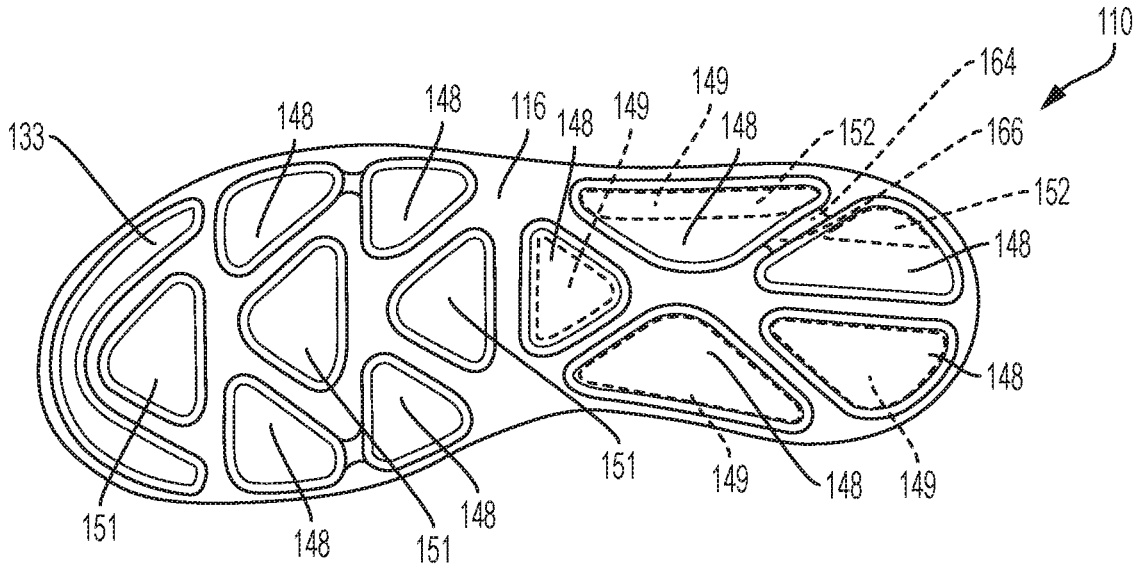
FIG. 19 is a bottom view of a further example of the footwear of FIG. 16.
Figure 21:
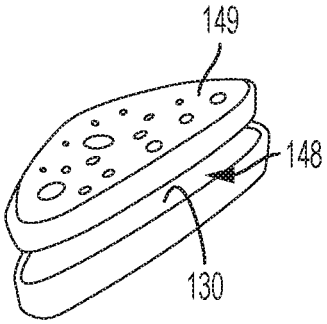
FIG. 21 is an isometric view of an example of a recess having an insert.

Midsole 118 may include a forefoot portion 138, a midfoot portion 140, and a heel portion 142. Additionally, the midsole may have an upper surface 144 and a lower surface 146. When attached, lower surface 146 and recesses 130 may define a plurality of chambers 148 having trapped air and/or other materials. Alternatively, or additionally, one or more chambers 148 may include gel, foam, and/or other materials. In some embodiments, one or more chambers 148 may include insert(s) or drop-in(s) 149 configured to be received in the recess(es) and/or chamber(s), as shown in FIGS. 19 and 21. Inserts 149 may provide, for example, for increased shock absorption and/or decreased pronation.

Sole 114 may include any suitable combination of air chambers, chambers with gel, chambers with foam, chambers with inserts, chambers with other materials, non-chamber projections, etc. depending on the shock absorption, traction, cushioning, and/or other characteristics desired. For example, FIG. 17 shows a plurality of chambers 148 having trapped air, gel, and/or foam. Additionally, FIG. 18 shows some of the chambers of FIG. 17 replaced with non-chamber projections 133 (which may be made, for example, from solid rubber). Moreover, FIG. 19 shows some of the chambers of FIG. 17 with inserts 149. The sole of FIG. 18 may provide, for example, increased abrasion resistance and may prevent or minimize pronation compared to the sole of FIG. 17. The sole of FIG. 19 may provide, for example, increased shock absorption compared to the sole of FIG. 17.

When outsole 116 includes one or more cavities 124, one or more extended portions 150 of midsole 118 may extend through and/or occupy those cavities. For example, when outsole 116 is segmented, portion(s) 150 of midsole 118 may extend through cavity 124, as shown in FIG. 13. When outsole 116 includes two or more cavities 124, two or more portions 150 of the midsole may extend through those cavities, such as shown in FIGS. 17-19. Extended portions 150 may include one or more projections 151, which may be shaped similar to and/or different from one or more projections 132. Projections 151 may be configured, for example, to contact a support surface when footwear 110 is in use. When a portion of midsole 118 is exposed and/or extends through a cavity in outsole 116, the midsole may be referred to as "exposed midsole" 118. Although sole 114 is shown to include cavity 124 between the forefoot and heel portions of the outsole in FIG. 13 and cavities 124 in the forefoot and heel portions of the outsole in FIGS. 17-19, sole 114 may alternatively, or additionally, include one or more cavities in any suitable portion(s) of the outsole, such as in the forefoot, midfoot, and/or heel portions. In those embodiments, midsole 118 may include one or more portions 150 that extend through the cavity(ies), and/or may include one or more projections 151.

Lower surface 146 of the midsole may include a plurality of protruding portions 152 that are configured to extend downwardly from lower surface 146 toward one or more recesses 130 of the outsole. The protruding portions may be contained within one or more chambers 148. Protruding portions 152 may have any suitable size(s) configured to be received in recesses 130 and/or chambers 148. For example, protruding portions 152 may occupy any suitable portion(s) of chambers 148.

The protruding portions may be distributed along lower surface 146 in any suitable configuration and/or layout to correspond to one or more recesses 130. For example, lower surface 146 may include transverse end portions 154, 156 and a central portion 158. In some embodiments, lower surface 146 may include protruding portions 152 in only transverse end portions 154, 156. Alternatively, that surface may include the protruding portions in only one or both of the transverse end portions, in only the central portion, and/or any suitable combination. In some embodiments, lower surface 146 may include protruding portions in only forefoot portion 138, in only midfoot portion 140, in only heel portion 142, in only the forefoot and heel portions, in only the midfoot and heel portions, or in only the forefoot and midfoot portions. Other combinations of the above configurations are included in the present disclosure.

Each portion of lower surface 146 may include any suitable number of protruding portions 152. For example, one or both transverse end portions 154, 156 and/or central portion 158 may each include one, two, three, four, five, six, seven, eight, nine or more protruding portions 152. Additionally, or alternatively, the forefoot, midfoot, and/or heel portion(s) may each include one, two, three, four, five, six, seven, eight, nine or more protruding portions 152. Protruding portions 152 may include at least one sidewall 160 that corresponds in shape to at least one sidewall 162 of recesses 130 such that, for example, the sidewalls are in contact with each other.

Lower surface 146 may include any suitable protruding portions 152 for all recesses 130 or for less than all of the recesses. For example, lower surface 146 may include protruding portions 152 in only one or both of the transverse end portions, in only the central portion, and/or any suitable combination. In some embodiments, lower surface 146 may include protruding portions 152 in only the forefoot portion, in only the midfoot portion, in only the heel portion, in only the forefoot and heel portions, in only the forefoot and midfoot portions, or in only the midfoot and heel portions. For example, FIG. 13 shows protruding portions 152 in only the transverse end portions and in only the forefoot and heel portions. Additionally, FIG. 15 shows protruding portions 152 throughout the sole of the shoe. Moreover, FIGS. 17-19 show protruding portions in only one or both of the transverse end portions and in only the heel portion. Other combinations of the above configurations are included in the present disclosure, such as protruding portions in only one transverse end portion and in only the forefoot and/or heel portions, etc.

Figure 20:
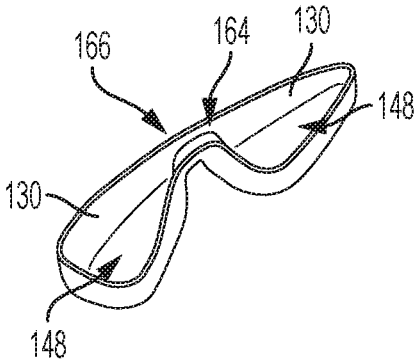
FIG. 20 is an isometric view of an example of two recesses of an outsole connected by a passage.

In some embodiments, two or more chambers 148 may be in fluid communication with each other, as shown in FIG. 20. For example, upper surface 126 of outsole 116 may include one or more connector recesses 164 such that, when the midsole and outsole are attached, lower surface 146 and connector recesses 164 define one or more passages 166 that fluidly connect two or more chambers. In other words, the passages allow two or more chambers to share the trapped air, gel, and/or other fluid(s) in the chambers. For example, FIGS. 17-19 show chambers 148 that are fluidly connected to each other via connector recesses 164.

Example 8

This section describes additional aspects and features of embodiments presented without limitation as a series of paragraphs, some or all of which may be alphanumerically designated for clarity and efficiency. Each of these paragraphs can be combined with one or more other paragraphs, and/or with disclosure from elsewhere in this application, in any suitable manner. Some of the paragraphs below expressly refer to and further limit other paragraphs, providing, without limitation, examples of some of the suitable combinations.

A0. A sole for footwear, the sole comprising:

a midsole having a first surface; and an outsole having a second surface and a plurality of first recesses, the second surface is attached to the first surface, the first surface of the midsole and the plurality of first recesses define a plurality of chambers having trapped air, the midsole further includes first protruding portions that extend downwardly from the first surface toward one or more first recesses of the plurality of first recesses.

A1. The sole of paragraph A0, wherein the first protruding portions include one or more walls that are shaped to correspond to part of the one or more first recesses such that the one or more walls are in contact with the part of those recesses.

A2. The sole of paragraph A1, wherein the plurality of first recesses includes a plurality of concave-shaped walls, and the one or more walls are convex-shaped to correspond to the plurality of concave-shaped walls such that the convex-shaped walls are in contact with at least a portion of the concave-shaped walls.

A3. The sole of any of paragraphs A0-A2, wherein the first protruding portions extend downwardly to contact a bottom surface of the one or more first recesses.

A4. The sole of any of paragraphs A0-A3, wherein the plurality of first recesses includes a bottom and a plurality of sidewalls.

A5. The sole of paragraph A4, wherein the plurality of first recesses includes inclined surfaces disposed between the plurality of sidewalls and the second surface.

A6. The sole of paragraph A5, wherein the first surface includes second protruding portions configured to be received on and contact the inclined surfaces of two or more first recesses of the plurality of first recesses.

A7. The sole of paragraph A6, wherein the second protruding portions include a convex-shaped perimeter, and the inclined surfaces are concave-shaped to correspond to the convex-shaped perimeter.

A8. The sole of paragraph A4, wherein one or more first recesses of the plurality of first recesses include a bottom and only three sidewalls.

A9. The sole of paragraph A4, wherein one or more first recesses of the plurality of first recesses include a bottom and only four sidewalls.

A10. The sole of any of paragraphs A0-A9, wherein the outsole includes transverse end portions and a central portion disposed between the transverse end portions, and the plurality of first recesses are distributed on the outsole such that each of the transverse end portions and the central portion includes two or more first recesses.

A11. The sole of paragraph A10, wherein the first protruding portions extend downwardly toward the two or more recesses in only the transverse end portions.

A12. The sole of any of paragraphs A0-A11, further comprising a gasket layer disposed between the first surface of the midsole and the second surface of the outsole, and the gasket layer is configured to seal the trapped air in the plurality of chambers.

A13. The sole of paragraph A12, wherein the first surface of the midsole includes a channel sized to receive the gasket layer, and the gasket layer is received in the channel.

A14. The sole of any of paragraphs A0-A13, wherein the outsole includes one or more second recesses, the first surface of the midsole and the one or more second recesses define one or more passages, and the one or more passages fluidly connects two or more chambers of the plurality of chambers.

A15. The sole of any of paragraphs A0-A14, wherein one or more chambers of the plurality of chambers include gel.

A16. The sole of any of paragraphs A0-A15, wherein one or more chambers of the plurality of chambers include foam.

A17. The sole of any of paragraphs A0-A16, wherein one or more first recesses of the plurality of recesses are elongate.

A18. The sole of paragraph A17, wherein the outsole includes first and second transverse end portions and a central portion disposed between the first and second transverse end portions, and the elongate one or more first recesses extend between the first and second transverse end portions.

A19. The sole of paragraph A18, wherein at least one elongate recess extends from one of the first and second transverse end portions, to the other of the first and second transverse end portions, and back to the one of the first and second transverse end portions.

A20. The sole of paragraph A17, wherein at least one elongate recess is ring-shaped.

A21. The sole of paragraph A17, wherein at least one elongate recess is kidney-shaped.

A22. The sole of any of paragraphs A0-A21, wherein the outsole includes a third surface that opposes the second surface, the third surface includes a plurality of first projections corresponding to the plurality of first recesses of the second surface, the plurality of first projections are configured to contact a support surface.

A23. The sole of paragraph A22, wherein the outsole is segmented and includes a forefoot portion and a heel portion defining a cavity therebetween.

A24. The sole of paragraph A23, wherein the midsole includes a midfoot portion that extends through the cavity.

A25. The sole of paragraph A24, wherein the midfoot portion includes a plurality of second projections configured to contact a support surface.

A26. The sole of paragraph A25, wherein one or more of the plurality of second projections are made of foam.

A27. The sole of any of paragraphs A0-A26, wherein the outsole includes a plurality of cavities and the midsole includes one or more projections that are received in and extend through the plurality of cavities such that the one or more projections are configured to be supported on a support surface.

A28. The sole of paragraph A27, wherein the one or more projections are made of foam.

B0. Footwear, comprising:

an upper for receiving a foot of a user; and a sole having a midsole and an outsole, the midsole has a first surface, the outsole has a second surface and a plurality of first recesses, the second surface is attached to the first surface, the first surface of the midsole and the plurality of first recesses define a plurality of chambers having trapped air, the midsole further includes first protruding portions that extend downwardly from the first surface toward one or more first recesses of the plurality of first recesses.

B1. The footwear of paragraph B0, wherein the first protruding portions include one or more walls that are shaped to correspond to part of the one or more first recesses such that the one or more walls are in contact with the part of those recesses.

B2. The footwear of paragraph B1, wherein the plurality of first recesses includes a plurality of concave-shaped walls, and the one or more walls are convex-shaped to correspond to the plurality of concave-shaped walls such that the convex-shaped walls are in contact with at least a portion of the concave-shaped walls.

B3. The footwear of any of paragraphs B0-B2, wherein the first protruding portions extend downwardly to contact a bottom surface of the one or more first recesses.

B4. The footwear of any of paragraphs B0-B3, wherein the plurality of first recesses includes a bottom and a plurality of sidewalls.

B5. The footwear of paragraph B4, wherein the plurality of first recesses includes inclined surfaces disposed between the plurality of sidewalls and the second surface.

B6. The footwear of paragraph B5, wherein the first surface includes second protruding portions configured to be received on and contact the inclined surfaces of two or more first recesses of the plurality of first recesses.

B7. The footwear of paragraph B6, wherein the second protruding portions include a convex-shaped perimeter, and the inclined surfaces are concave-shaped to correspond to the convex-shaped perimeter.

B8. The footwear of paragraph B4, wherein one or more first recesses of the plurality of first recesses include a bottom and only three sidewalls.

B9. The footwear of paragraph B4, wherein one or more first recesses of the plurality of first recesses include a bottom and only four sidewalls.

B10. The footwear of any of paragraphs B0-B9, wherein the outsole includes transverse end portions and a central portion disposed between the transverse end portions, and the plurality of first recesses are distributed on the outsole such that each of the transverse end portions and the central portion includes two or more first recesses.

B11. The footwear of paragraph B10, wherein the first protruding portions extend downwardly toward the two or more recesses in only the transverse end portions.

B12. The footwear of any of paragraphs B0-B11, further comprising a gasket layer disposed between the first surface of the midsole and the second surface of the outsole, and the gasket layer is configured to seal the trapped air in the plurality of chambers.

B13. The footwear of paragraph B12, wherein the first surface of the midsole includes a channel sized to receive the gasket layer, and the gasket layer is received in the channel.

B14. The footwear of any of paragraphs B0-B13, wherein the outsole includes one or more second recesses, the first surface of the midsole and the one or more second recesses define one or more passages, and the one or more passages fluidly connects two or more chambers of the plurality of chambers.

B15. The footwear of any of paragraphs B0-B14, wherein one or more chambers of the plurality of chambers include gel.

B16. The footwear of any of paragraphs B0-B15, wherein one or more chambers of the plurality of chambers include foam.

B17. The footwear of any of paragraphs B0-B16, wherein one or more first recesses of the plurality of recesses are elongate.

B18. The footwear of paragraph B17, wherein the outsole includes first and second transverse end portions and a central portion disposed between the first and second transverse end portions, and the elongate one or more first recesses extend between the first and second transverse end portions.

B19. The footwear of paragraph B18, wherein at least one elongate recess extends from one of the first and second transverse end portions, to the other of the first and second transverse end portions, and back to the one of the first and second transverse end portions.

B20. The footwear of paragraph B17, wherein at least one elongate recess is ring-shaped.

B21. The footwear of paragraph B17, wherein at least one elongate recess is kidney-shaped.

B22. The footwear of any of paragraphs B0-B21, wherein the outsole includes a third surface that opposes the second surface, the third surface includes a plurality of first projections corresponding to the plurality of first recesses of the second surface, the plurality of first projections are configured to contact a support surface.

B23. The footwear of paragraph B22, wherein the outsole is segmented and includes a forefoot portion and a heel portion defining a cavity therebetween.

B24. The footwear of paragraph B23, wherein the midsole includes a midfoot portion that extends through the cavity.

B25. The footwear of paragraph B24, wherein the midfoot portion includes a plurality of second projections configured to contact a support surface.

B26. The footwear of paragraph B25, wherein one or more of the plurality of second projections are made of foam.

B27. The footwear of any of paragraphs B0-B26, wherein the outsole includes a plurality of cavities and the midsole includes one or more projections that are received in and extend through the plurality of cavities such that the one or more projections are configured to be supported on a support surface.

B28. The footwear of paragraph B27, wherein the one or more projections are made of foam.

CONCLUSION

The disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any claim recites "a" or "a first" element or the equivalent thereof, such claim should be understood to include incorporation of one or more such elements, neither requiring nor excluding two or more such elements.

Inventions embodied in various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

What is claimed is:

1. A sole for footwear, the sole comprising:

a midsole having a first surface; and an outsole having a second surface and a plurality of first recesses, one or more of the first recesses each having a side wall and a bottom surface;

wherein the second surface is attached to the first surface, the first surface and the plurality of first recesses define a plurality of chambers, and one or more chambers of the plurality of chambers includes trapped air;

the midsole further including first protruding portions that extend downwardly from the first surface toward the one or more first recesses of the plurality of, such that each of the first protruding portions is in continuous contact with the side wall and the bottom surface of a corresponding one of the one or more first recesses;

wherein the outsole includes a third surface that opposes the second surface, the third surface includes a plurality of first projections corresponding to the plurality of first recesses of the second surface, the plurality of first projections are configured to contact a support surface, the outsole is segmented and includes a forefoot portion and a heel portion defining a cavity therebetween, and the midsole includes a midfoot portion that extends through the cavity.

2. The sole of claim 1, wherein the midfoot portion includes a plurality of second projections configured to contact a support surface.

3. The sole of claim 1, wherein two of the first protruding portions contact the side wall and the bottom surface of a same corresponding one of the one or more first recesses.

4. Footwear, comprising:

an upper for receiving a foot of a user; and a sole having a midsole and an outsole, the midsole has a first surface, the outsole has a second surface and a plurality of first recesses, one or more of the first recesses each having a side wall and a bottom surface;

wherein the second surface is attached to the first surface, the first surface and the plurality of first recesses define a plurality of chambers, and one or more chambers of the plurality of chambers includes trapped air;

the midsole further including first protruding portions that extend downwardly from the first surface toward the one or more first recesses, such that each of the first protruding portions is in continuous contact with the side wall and the bottom surface of a corresponding one of the one or more first recesses, wherein the outsole includes a third surface that opposes the second surface, the third surface includes a plurality of first projections corresponding to the plurality of first recesses of the second surface, the plurality of first projections are configured to contact a support surface, the outsole is segmented and includes a forefoot portion and a heel portion defining a cavity therebetween, the midsole includes a midfoot portion that extends through the cavity, and the midfoot portion includes a plurality of second projections configured to contact a support surface.

5. The footwear of claim 4, wherein two of the first protruding portions contact the side wall and the bottom surface of a same corresponding one of the one or more first recesses.

* * * * *